US007017279B2

(12) United States Patent
Almi et al.

(10) Patent No.: US 7,017,279 B2
(45) Date of Patent: Mar. 28, 2006

(54) METHOD AND APPARATUS FOR BLOWING DRYING GAS IN A PAPER MACHINE

(75) Inventors: Jari Almi, Tampere (FI); Jarkko Veijola, Turku (FI); Jarkko Nurmi, Turku (FI); Antti Komulainen, Keuruu (FI); Kari Juppi, Palokka (FI)

(73) Assignee: Metso Automation OY, Helsinki (FI)

( * ) Notice: Subject to any disclaimer, the term of this patent is extended or adjusted under 35 U.S.C. 154(b) by 0 days.

(21) Appl. No.: 10/738,479

(22) Filed: Dec. 17, 2003

(65) Prior Publication Data

US 2004/0143993 A1 Jul. 29, 2004

Related U.S. Application Data

(63) Continuation of application No. PCT/FI02/00556, filed on Jun. 25, 2002.

(30) Foreign Application Priority Data

Jun. 26, 2001 (FI) ..... 20011363

(51) Int. Cl.
*F26B 3/00* (2006.01)

(52) U.S. Cl. ..... 34/451; 34/114; 34/119

(58) Field of Classification Search ..... 34/451, 34/453, 456, 457, 114, 119, 446, 454
See application file for complete search history.

(56) References Cited

U.S. PATENT DOCUMENTS 3,089,252 A * 5/1963 Daane et al. ..... 34/114
4,573,402 A 3/1986 Sharma et al.
5,090,133 A 2/1992 Taylor
5,752,324 A * 5/1998 Muller et al. ..... 34/114

FOREIGN PATENT DOCUMENTS

| | | |
|---|---|---|
| DE | 36 14 534 | 7/1987 |
| EP | 1 143 067 | 10/2001 |
| WO | WO 99/51813 | 10/1999 |

OTHER PUBLICATIONS

Copy of Official Action issued in Finnish Priority Appl. No. 20011363 dated May 13, 2002.
Copy of International Search Report for PCT/FI02/00556 dated Oct. 7, 2002.

* cited by examiner

*Primary Examiner*—Kenneth Rinehart
(74) *Attorney, Agent, or Firm*—Alston & Bird LLP

(57) ABSTRACT

A method of blowing drying gas against a paper web, and an impingement dryer of a paper machine. Drying gas is blown with an impingement dryer comprising several profiling chambers in the cross-direction of a paper machine, the cross-profile of the paper web being controlled with the drying gas blown from the profiling chambers. Each profiling chamber blows drying gas to its own effect range. The impingement dryer further comprises a return air chamber and return air ducts such that drying gas blown against the paper web from the profiling chambers is returned into the return air chamber through the return air ducts in such a way that some of the effect of the drying gas blown from the profiling chamber is at least partly prevented from reaching the effective area of the adjacent profiling chamber.

27 Claims, 4 Drawing Sheets

METHOD AND APPARATUS FOR BLOWING DRYING GAS IN A PAPER MACHINE

CROSS-REFERENCE TO RELATED APPLICATIONS

This application is a continuation of International Application PCT/FI02/00556 filed on Jun. 25, 2002, which designated the U.S. and was published under PCT Article 21(2) in English, and which is hereby incorporated herein in its entirety by reference.

BACKGROUND OF THE INVENTION

1) Field of the Invention

The invention relates to a method of blowing drying gas against a paper web, in which method drying gas is blown with an impingement dryer comprising a plurality of profiling chambers in the cross-direction of a paper machine, the cross-profile of the paper web being controlled by means of the drying gas blown from the profiling chambers; each profiling chamber blowing drying gas to its own effective area; and the impingement dryer further comprising a return air chamber and return air ducts in such a way that drying gas blown against the paper web from the profiling chambers is returned into the return air chamber through the return air ducts.

Further, the invention relates to an impingement dryer of a paper machine, comprising a plurality of profiling chambers in the cross-direction of the paper machine, the profiling chambers being arranged to control the cross-profile of a paper web in such a way that each profiling chamber is arranged to blow drying gas against the paper web to its own effective area; and the impingement dryer further comprising a return air chamber and return air ducts in such a way that drying gas blown against the paper web is arranged to be returned into the return air chamber through the return air ducts.

2) Description of Related Art

A paper web produced is dried in the dryer section of a paper machine before it is reeled to the reeler of the paper machine. The dryer section typically comprises several dozens of cylinders through which the paper web travels supported by the dryer fabric. The cylinders of the dryer section are hot steam-heated cylinders that evaporate moisture from the web while the web is travelling through the cylinders. Apart from steam-heated cylinders, at least part of the cylinders are vacuum rolls, in other words what are called vac rolls. In the vacuum rolls, vacuum prevails that sucks the paper web into contact with the fabric, whereby the web moves over to the next dryer cylinder without interruptions.

A problem with the drying of a paper web is the control of the moisture profile of the web cross-profile in such a way that the moisture profile of the web stays as desired, as regards both the runnability of the web and the preservation of the web profile properties in the paper machine itself, but also during the storage, transport and end use, such as printing, of the paper. Presently, a steam box mounted on a press before the dryer section of the paper machine or a dampener positioned in the dryer section is used to correct the moisture profile of paper. A steam box or a dampener is not, however, applicable to all points of the dryer section. In addition, moistening the web is uneconomical and lowers the overall efficiency of the paper machine, because in the dryer section, the intention is to dry paper as efficiently as possible; however, adding water to the web makes it necessary to use part of the drying capacity to remove this added water.

To make the removal of moisture from the web more efficient, paper machines also utilize impingement-blowing units positioned in the dryer section. The impingement-blowing unit consists of a vacuum roll in connection of which there is an impingement dryer. As regards its diameter, the vacuum roll of the impingement dryer may be greater than a conventional drying cylinder. The nozzle surface of the impingement dryer is at a certain distance from the surface of the roll, whereby a drying zone is formed between the dryer and the roll. When the paper web travels supported by the dryer fabric through the drying zone, hot air is blown to the web from the dryer. Most of the air blown towards the paper web is returned to the dryer to be heated and re-blown towards the web. In order to maintain moisture of the drying air to be blown at a desired level, part of the moist drying air returned from the drying zone is discharged as exhaust air and replaced with a required amount of fresh substitution air. Control parameters used in the impingement-blowing drying are usually the blowing temperature and the blowing rate. In a known dryer that is arranged in connection with a steam-heated drying cylinder, the blowing chamber of the dryer is divided into profiling chambers in the cross-direction of the paper machine, whereby drying air can be blown from the profiling chambers to the paper web to the effective area of each profile chamber. This type of an impingement dryer has, however, the problem that the drying air blown from one profiling chamber is spread in the cross-direction of the paper web also to the effective area of the adjacent profiling chambers, which weakens the profiling effect of the dryer. Present impingement dryers has the problem that not even with them is it possible to achieve sufficiently accurate control of the paper web cross-profile, which would be required by the modern production and quality standards.

BRIEF SUMMARY OF THE INVENTION

An object of the present invention is to provide a method and an impingement dryer by means of which the profiling effect of the impingement dryer can be improved.

The method according to the invention is characterized by returning drying gas blown against the paper web into the return air chamber through the return air ducts in such a way that the effect of the drying gas blown from the profiling chamber is at least partly prevented from reaching the effective area of the drying gas blown from the adjacent profiling chamber.

Further, the impingement dryer according to the invention is characterized in that the return air ducts are arranged between the profiling chambers in such a way that drying gas blown against the paper web from the profiling chambers is arranged to be returned into the return air chamber through the return air ducts without the drying gas essentially affecting the effective area of the adjacent profiling chamber.

According to an essential idea of the invention, the cross-profile of the paper web is controlled by blowing drying gas against the paper web with an impingement dryer comprising several profiling chambers in the cross-direction of the paper machine, each of the profiling chambers blowing drying gas to its own effective area. The impingement dryer further comprises a return air chamber and return air ducts in such a way that drying gas blown against a paper web from the profiling chamber is returned into the return air chamber through the return air ducts. Furthermore, according to an essential idea of the invention, drying gas is returned into the return air chamber through the return air ducts in such a way that the effect of the drying gas blown from the profiling chamber is at least partly prevented from reaching the effective area of the drying gas blown from the adjacent profiling chamber. According to a preferred embodiment of the invention, the return air duct is a slot between the profiling chambers. According to a second preferred embodiment of the invention, the impingement dryer is arranged in connection with the vacuum roll of the dryer section of a paper machine. According to a third preferred embodiment of the invention, the impingement dryer is arranged below the vacuum roll in the basement of the paper machine.

An advantage of the invention is that an impingement dryer allows control of the cross-profile of the paper web more accurately than before when the effect of the drying gas blown from the profiling chamber of the impingement dryer is at least partly prevented from reaching the effective area of the adjacent profiling chamber through return air ducts arranged between the profiling chambers. The profiling accuracy is very good when the return air duct is a slot between the profiling chambers. Positioning the impingement dryer in connection with a vacuum roll, i.e. a vac roll, in the dryer section of a paper machine, and preferably also below it in the basement of the paper machine, provides, in addition to good profiling accuracy, also an efficient solution as regards the use of space.

In the present description, the term 'paper' refers not only to paper but also to board, tissue and pulp.

BRIEF DESCRIPTION OF THE SEVERAL VIEWS OF THE DRAWINGS

The invention will now be explained in more detail in the drawings, of which

DETAILED DESCRIPTION OF THE INVENTION

Figure 1:
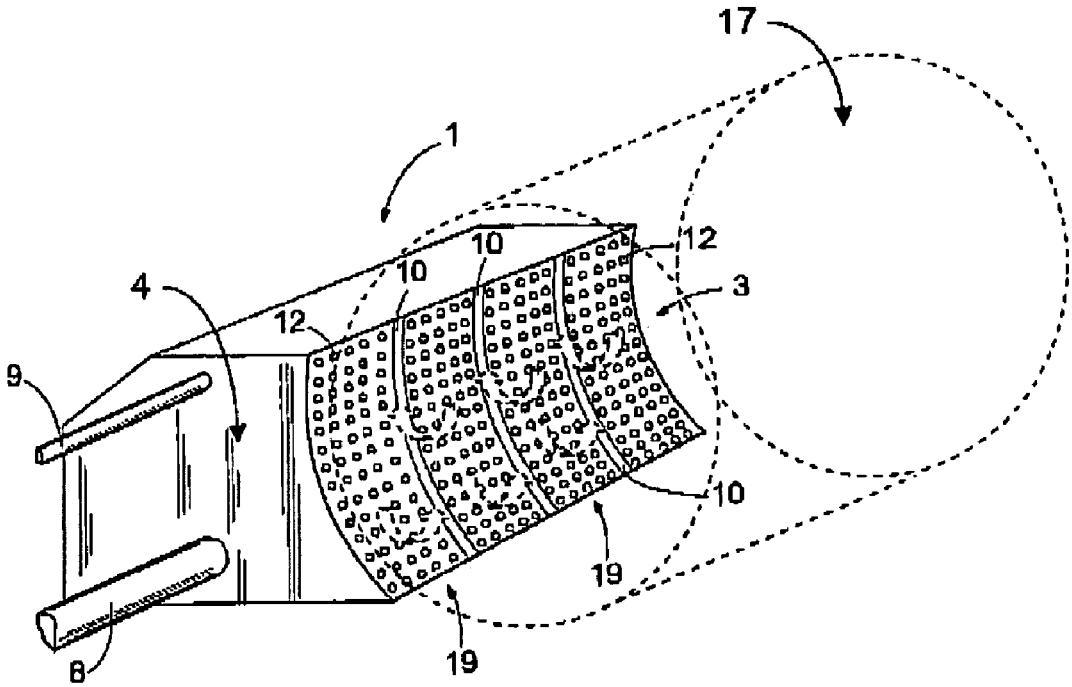
FIG. 1 schematically shows a perspective view of an impingement dryer according to the invention.
Figure 2:
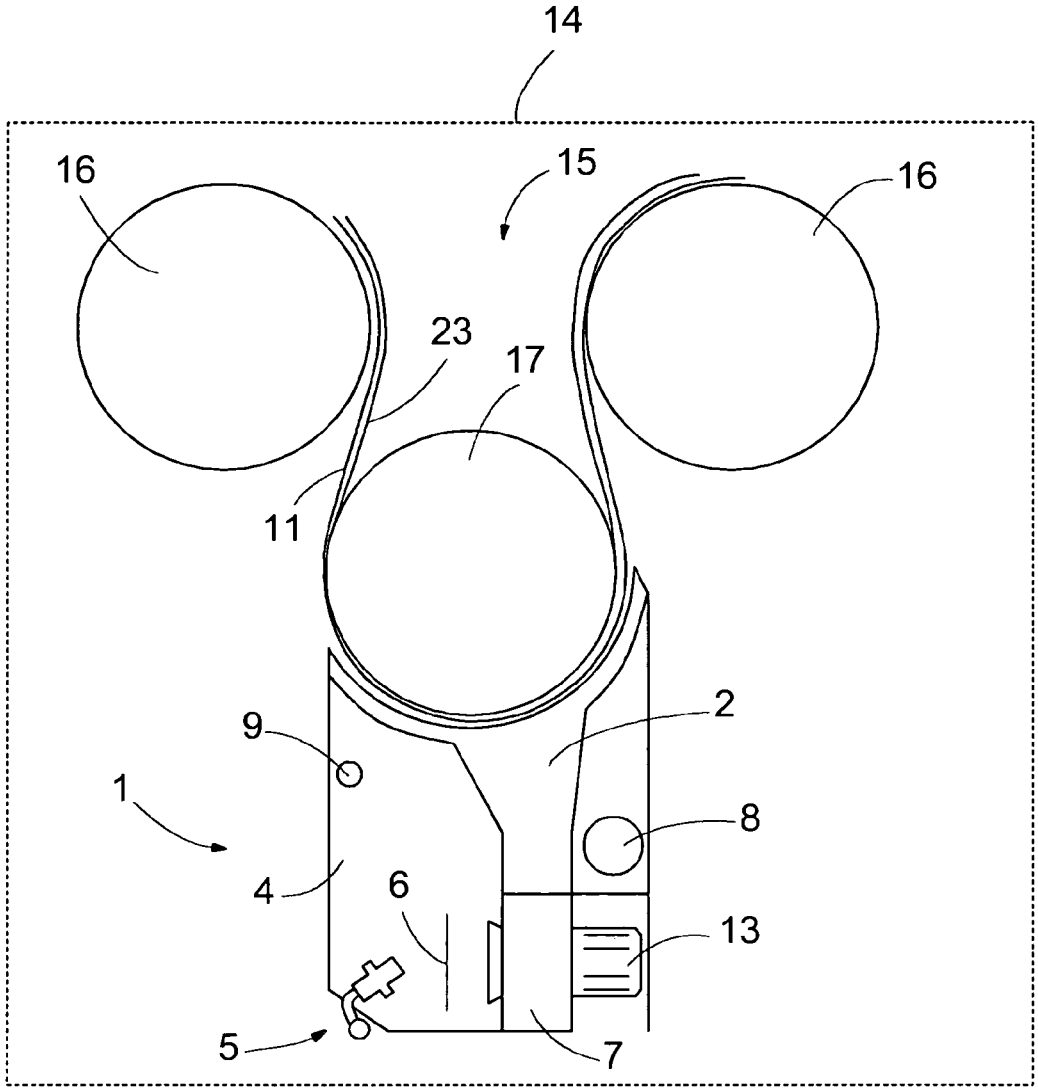
FIG. 2 schematically shows a partial cross-section of the dryer section of a paper machine.

FIG. 1 schematically shows a perspective view of an impingement dryer 1 according to the invention. FIG. 2 shows a schematic cross-section of the structure of an impingement dryer, seen from the end of the dryer 1. Hereafter, in the present description, the impingement dryer 1 is also called a dryer 1. The dryer 1 comprises a blowing chamber 2, a nozzle surface 3, a return air chamber 4, a burner 5, a flame guard 6, a recirculation fan 7, an exhaust air duct 8, a substitution air duct 9 and a return air duct 10.

With the dryer 1, hot drying gas is blown at a high rate against a paper web 11 to dry the web. The drying gas is typically air, but it can also be superheated steam or another gas or a gas mixture, such as a mixture of air and combustion gases of a burner. The temperature of the drying gas can be for instance 350° C. and the rate about 90 meters per second. The temperature of the drying gas can, however, vary between 200° C. and 600° C., the rate of the drying gas usually varying between 50 and 150 m/s. Hereafter, it is assumed in this description that the drying gas is air, although naturally it can be another gas or a gas mixture.

When the hot drying air is blown into contact with a moist paper web 11, the drying air transfers thermal energy to the paper web 11. The water in the paper is evaporated into the ambient air. The drying air that has cooled down to a temperature of about 250° C. and moistened is returned as return air to the dryer 1. The attainable evaporation efficiency depends for instance on the blowing parameters, which include temperature, rate and moisture level of the blowing air. Further, the evaporation efficiency also depends on the dry matter content, initial temperature and the mass composition of the paper web 11.

The hot drying air is conveyed through the blowing chamber 2 of the dryer 1 towards the paper web 11. The nozzle surface 3 of the blowing chamber 2 comprises small holes, i.e. blowing nozzles 12, through which the air travels from the blowing chamber 2 against the paper web 11. The form of the blowing nozzles 12 can vary in a plurality of ways, but preferably the blowing nozzles 12 are round or what are called hole nozzles, the diameter of which is usually about 5 mm. The return air and the water evaporated from the paper web 11 along with it are conveyed into the return air chamber 4 of the dryer 1 through the return air ducts 10. Most of the return air arriving in the return air chamber 4 is circulated with the recirculation fan 7 back to the blowing chamber 2. The recirculation fan 7 allows achievement of the required pressure effect both for blowing drying air against the paper web 11 and for sucking the return air back to the return chamber 4 through the return air ducts 10. The amount of air provided by the recirculation blower 7 and thus also the blowing rate in the blowing nozzles 12 are adjusted by controlling the speed of rotation of the engine 13 of the recirculation blower 7. The return air chamber 4 comprises a burner 5, which is for instance an oil burner by means of which drying air to be blown to the blowing chamber 2 is heated. The temperature of the drying air is adjusted by changing the power of the burner 5. Between the burner 5 and the recirculation blower 7, there is a flame guard 6, the purpose of which is to protect the recirculation fan 7 against the very hot flame of the burner 5.

Typically, about 20% of the return air is discharged from the dryer 1 to remove the water evaporated from the paper web. The exhaust air to be discharged is sucked from the return air chamber 4 through the exhaust air duct 8. This exhaust air to be discharged is replaced with substitution air supplied into the return air chamber 4. The substitution air is brought to the return air chamber 4 through the substitution air duct 9.

The basic principle of the impingement dryer 1 is obvious as such to a person skilled in the art and is not, therefore, described in more detail herein. Thus, for the sake of clarity, equipment used in the handling of the discharge air and substitution air and positioned outside the dryer 1, such as an exhaust air blower and substitution air blower, is omitted from FIGS. 1 and 2. It is also obvious that although FIG. 2 and the specification present only one burner 5, one flame guard 6 and one recirculation blower 7, the dryer 1 can, and typically does, comprise more than one such item. Further, it is obvious as such to a person skilled in the art that drying air can be heated not only with the burner 5 but also with steam through a heat exchanger.

FIG. 2 shows schematically the positioning of the dryer 1 in the dryer section 15 of a paper machine 14. The paper machine 14 is shown very schematically as a broken line surrounding the dryer section 15. FIG. 2 illustrates only a very small part of the conventional steam-heated dryer cylinders 16 and the vacuum rolls, i.e. vac rolls 17, which are usually part of the dryer section 15 of a paper machine 14. The dryer 1 in FIG. 2 is positioned below a vacuum roll, i.e. a vac roll 17, in the basement of the paper machine, but it can also be positioned in many other ways in connection with a vacuum roll 17. The dryer section can also comprise a vacuum roll the diameter of which is greater than that of an ordinary vacuum roll 17, the dryer 1 being arranged in connection with this roll. An ordinary vacuum roll 17 typically refers to such a vacuum roll 17 the diameter of which is about 1,500 mm but the diameter of which can, however, considerably deviate from this. Irrespective of whether a particular case involves an ordinary vacuum roll, i.e. a vac roll 17, or a vacuum roll having a greater diameter, the dryer 1 and the vacuum roll form what is called an impingement-blowing unit. The impingement blowing takes place directly against the paper web 11, which travels supported against the wire or fabric 23. The direction of travel of the paper web 11 is shown in FIG. 2 by arrow A. For the sake of clarity, FIG. 2 does not show auxiliary rolls or support structures of the dryer section 15, or the like parts of the dryer section 15, which are known as such to a person skilled in the art. The distance between the nozzle surface 3 of the blowing chamber 2 and the paper web 11 is typically about 25 mm. The distance directly affects the evaporation efficiency. If the distance is clearly longer than 25 mm, the drying efficiency is weakened. If, on the other hand, the distance is clearly shorter than 25 mm, there may be problems in connection with a web break, in other words the paper web 11 can collide with the blowing chamber 2 and cause a blockage in the paper machine 14.

Figure 3:
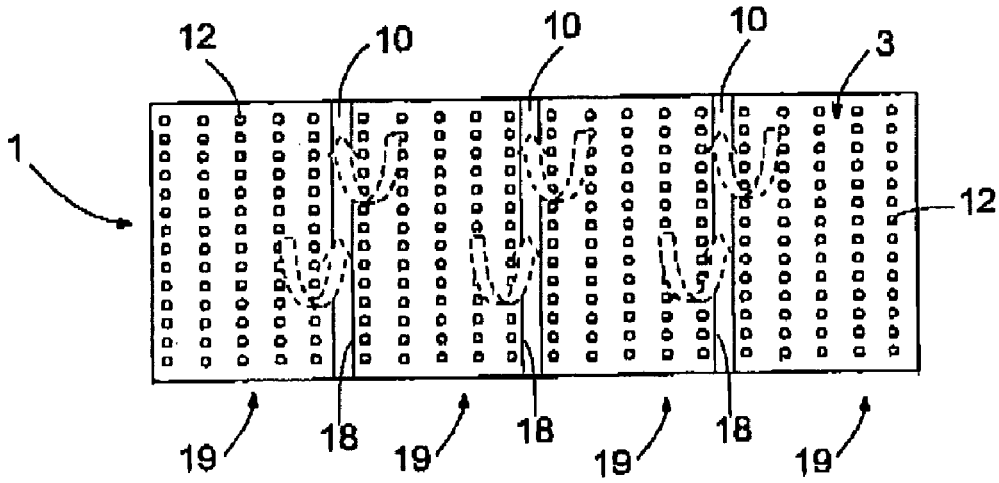
FIG. 3 schematically shows an impingement dryer according to FIG. 1, seen from the direction of the paper web.
Figure 4:
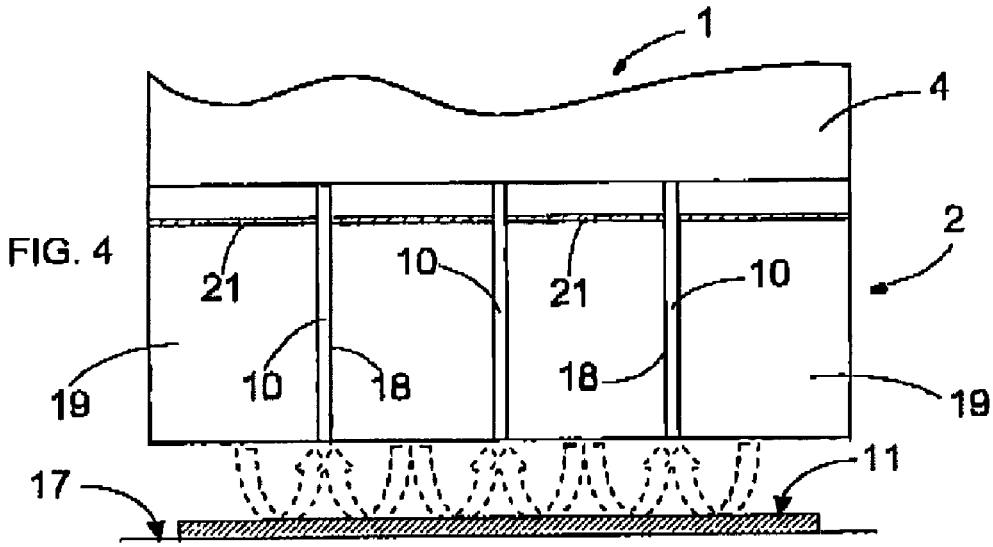
FIG. 4 schematically shows a cross-section of an impingement dryer according to FIG. 1, seen obliquely from up, from the right.

In order to control the moisture profile of the paper web 11 cross-profile, the blowing chamber 2 is divided in the cross-direction of the paper machine 14 into profiling chambers 19 with machine-direction intermediate walls 18, which is schematically shown in FIG. 3, seen from the direction of the paper web 11. In FIG. 4, the dryer 1 according to FIGS. 1 and 3 is shown schematically in a simplified manner and as a cross-section, and as compared with FIG. 1 obliquely from up, from the right. The blowing chamber 2 is divided into profiling chambers 19 over the whole machine-direction distance in such a way that between the profiling chambers 19 there remains one continuous, slot-like return air duct 10 extending over the whole length of the profiling chamber in the machine direction, the return air being conveyed through the return duct 10 back into the return air chamber 4 by the suction effect of the recirculation blower 7. The profiling chambers 19 can also be arranged as completed blocks in the blowing chamber 2 in such a way that there remains a slot-like return air duct 10 between the profiling chambers. Owing to the profiling chambers 19, the moisture profile of the paper web 11 cross profile can be controlled by blowing a different amount of drying air to different parts of the paper web 11 through the profiling chambers 19. The slot-like return air duct 10 extending in the machine direction over the whole length of the profiling chamber 19 prevents drying air blown from the profiling chamber 19 to the paper web 11 from spreading to the effective area of the adjacent profiling chambers 19; in other words, the drying air blown from each profiling chamber 19 mainly affects in the paper web 11 only the effective area of the profiling chamber 19 in question. Thus, the effect of the drying gas can be limited very accurately to a certain area in the cross-direction of the paper web 11, owing to which the control of the cross-profile of the paper web 11 is clearly more accurate than previously.

The width of the profiling chamber 19 in the cross-direction of the dryer 1 can vary between 30 to 70 mm. Preferably, the width of the profiling chamber is about 50 to 60 mm. The width of the slot-like return air ducts 10 can also vary, being preferably about 5 to 10 mm. Thus, in a paper machine having a very great line width, the number of profiling chambers 19 can be almost hundreds, whereby the profiling effect provided with the dryer 1 in the paper web 11 can be directed at a very narrow area. For the sake of clarity, FIGS. 1, 3 and 4 illustrate only a few profiling chambers 19.

Figure 5:
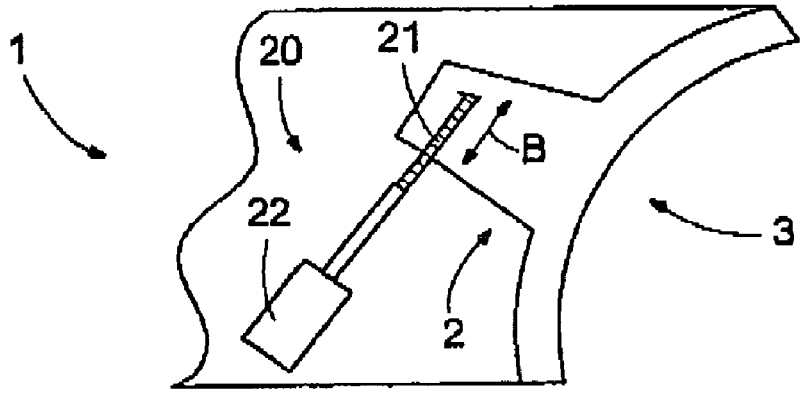
FIG. 5 schematically shows a side view and a cross-section of an impingement dryer according to FIG. 1.

The amount of blowing air blown to the web through a single profiling chamber 19 is controlled with a control unit 20 arranged in connection with the profiling chamber 19, shown schematically in FIG. 5 where the dryer b according to FIG. 3 is illustrated schematically as seen from the end and cross-sectioned at the point of the profiling chamber 19. The control unit 20 comprises a damper 21 and an actuator moving it in the direction of arrow B, position measurement being connected to the actuator, whereby an appropriate amount of air can be conveyed into the profiling chamber 19. The actuator can be for instance a spindle motor 22, which is naturally connected to the rest of the automatic system of the paper machine 14. The damper 21 is shaped in such a way that the dampers drawn open do not prevent the flow of air into the exhaust air duct 8 or to the recirculation blower 7 to be blown further against the paper web 11. For the sake of clarity, FIG. 5 does not show a recirculation fan 7, a burner 5, a flame guard 6, an exhaust air duct 8 or a substitution air duct 9.

Figure 6:
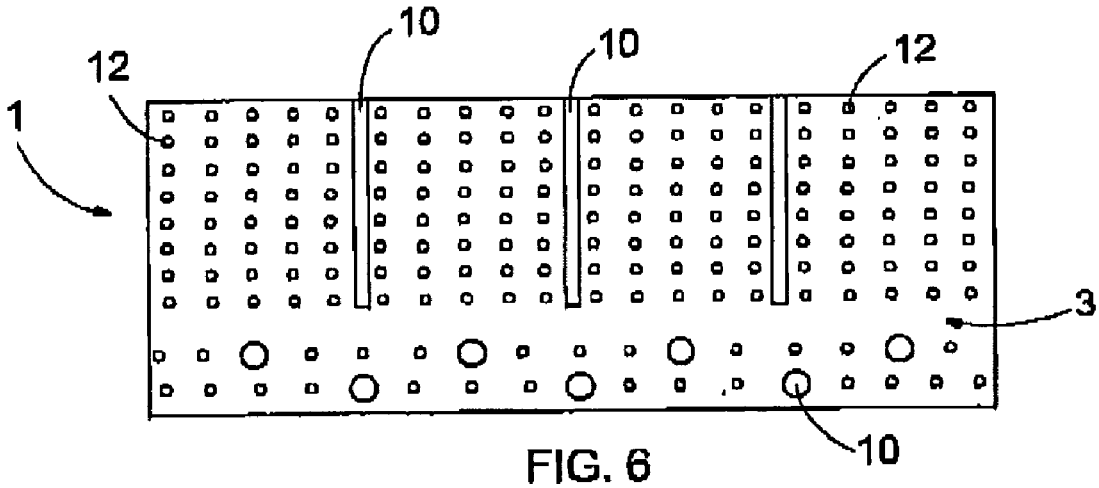
FIG. 6 schematically shows an impingement dryer according to the invention, seen from the direction of the paper web.

FIG. 6 shows schematically a second dryer 1 according to the invention, seen from the direction of the paper web 11. In the embodiment according to FIG. 6, the blowing chamber 2 is divided into profiling chambers 19 only over a part of the area in the direction of travel of the paper web 11, i.e. in the machine direction of the paper machine 14. In the bottom part of FIG. 6, the blowing chamber 2 is one continuous space in the cross-direction of the paper web 11, and return air ducts 10 are pipes which have in FIG. 6 an annular cross-section but the cross-section form of which can also vary.

Figure 7:
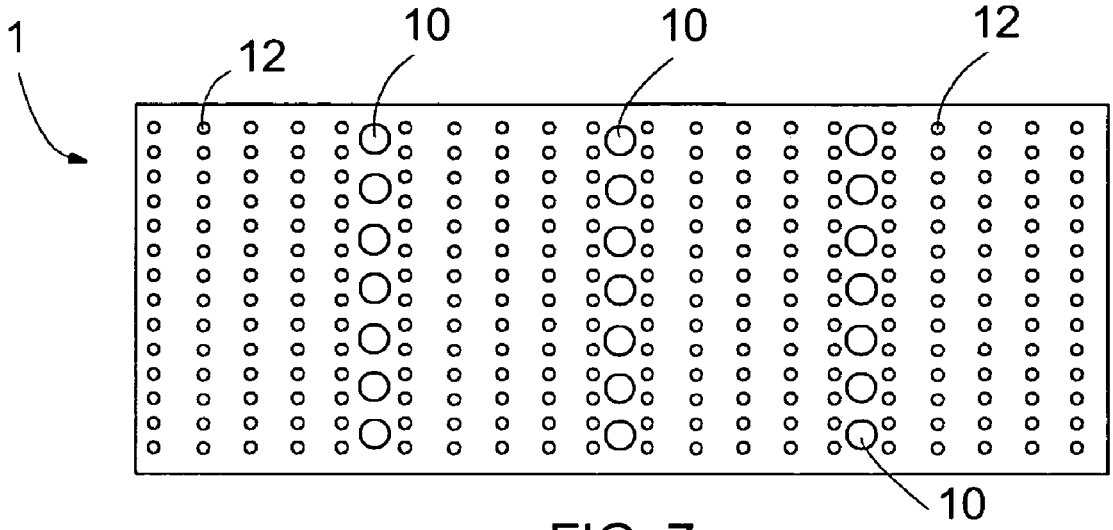
FIG. 7 schematically shows an impingement dryer according to the invention, seen from the direction of the paper web.

FIG. 7 shows schematically a third dryer 1 according to the invention, seen from the direction of the paper web 11. In the dryer 1 according to FIG. 7, slot-like return air ducts 10 have been replaced with hole-like return air ducts 10 formed on the nozzle surface 3 of the blowing chamber 2 almost next to each other or at a distance from each other in the machine direction of the paper machine, the cross-section form of which ducts can deviate from the annular form shown in FIG. 7. In such a case, the spreading of the drying gas supplied from the profiling chamber 19 to the effective area of the adjacent chamber is not necessarily prevented as well as with a continuous slot-like return air duct 10, but also the profiling effect of the dryer 1 according to FIG. 7 is clearly better compared with previous solutions.

The drawings and the related specification are only intended to illustrate the idea of the invention. The details of the invention can vary within the scope of the claims. Thus, it is obvious that the impingement dryer according to the invention can be implemented as a plane-like dryer used for plane-like impingement drying, whereby the nozzle surface of the dryer is straight or nearly straight, deviating thus from the form imitating the form of a roll as presented in the figures. The plane-like impingement dryer is preferably positioned immediately after the press of the paper machine, where drying air is blown against the web at such a point where the web is supported only against the wire. Further, it is obvious that the dryer is typically arranged in the paper machine in such a way that the impingement blowing takes place directly against the paper web, but that it is possible to arrange the dryer in the paper machine also in such a way that the impingement blowing can take place by blowing through the wire or fabric supporting the paper web. Further, it is obvious that the dryer 1 can also be positioned in connection with a steam-heated cylinder, if desired. Further, as regards the burner 5, flame guard 6, recirculation fan 7, exhaust air duct 8 and substitution air duct 9 and related structures, the dryer 1 can be implemented in a plurality of ways, deviating from the figures. Further still, one drying unit may comprise several dryers 1, and in connection with an ordinary vacuum roll b, there may be several dryers 1, depending on the available space.

The invention claimed is:

1. A method of blowing drying gas against a paper web with an impingement dryer, so as to control a cross-profile of the paper web, said method comprising:

blowing the drying gas from a plurality of profiling chambers directly against the paper web, each profiling chamber extending in a machine direction and the profiling chambers being adjacently disposed in the cross-direction of a paper machine, such that each profiling chamber blows the drying gas to its own effective area of the paper web in the cross-direction of the paper machine; and collecting the drying gas blown against the paper web into a return air chamber via return air ducts in communication with the return air chamber and arranged between adjacent profiling chambers so as to separate the profiling chambers, the profiling chambers and the return air ducts being arranged such that drying gas blown against the paper web from the profiling chambers is returned into the return air chamber through the return air ducts-without the drying gas from one profiling chamber affecting the effective area of the adjacent profiling chamber.

2. A method according to claim 1, wherein drying gas is returned into the return air chamber through return air ducts configured as elongate slots extending in the machine direction and arranged between the profiling chambers.

3. A method according to claim 1, wherein drying gas is returned into the return air chamber through return air ducts configured as a series of holes extending in the machine direction and arranged between the profiling chambers.

4. A method according to claim 1, wherein the amount of drying gas blown from the profiling chamber is adjusted with a control unit arranged in connection with the profiling chamber.

5. A method according to claim 4, wherein the control unit comprises a damper and an actuator that moves it.

6. A method according to claim 5, wherein the actuator is a spindle motor.

7. A method according to claim 1, wherein the temperature of the drying gas is arranged between 200° C. and 600° C.

8. A method according to claim 1, wherein the blowing rate of the drying gas is arranged between 50 and 150 m/s.

9. A method according to claim 1, wherein the drying gas is air.

10. A method according to claim 1, wherein the drying gas is superheated steam.

11. An impingement dryer of a paper machine, comprising:

a plurality of profiling chambers, each profiling chamber extending in a machine direction and the profiling chambers being adjacently disposed in the cross-direction of the paper machine, for controlling the cross-profile of a paper web by each profiling chamber being arranged to blow drying gas directly against the paper web to its own effective area of the paper web in the cross-direction of the paper machine; and a return air chamber in communication with return air ducts and arranged such that drying gas blown against the paper web is collected into the return air chamber through the return air ducts, the return air ducts being arranged between adjacent profiling chambers so as to separate the profiling chambers, the profiling chambers and the return air ducts being arranged such that drying gas blown against the paper web from the profiling chambers is returned into the return air chamber through the return air ducts without the drying gas from one profiling chamber affecting the effective area of the adjacent profiling chamber.

12. An impingement dryer according to claim 11, wherein the return air duct is an elongate slot extending in the machine direction and arranged between the profiling chambers.

13. An impingement dryer according to claim 11, wherein the return air duct is configured as a series of holes extending in the machine direction and arranged between the profiling chambers.

14. An impingement dryer according to claim 11, wherein the width of the profiling chamber is 30 to 70 mm.

15. An impingement dryer according to claim 11, wherein the width of the return air duct is 5 to 10 mm.

16. An impingement dryer according to claim 11, comprising further a control unit in connection with the profiling chamber in order to adjust the amount of drying gas to be supplied to the profiling chamber.

17. An impingement dryer according to claim 16, wherein the control unit comprises a damper and an actuator that moves it.

18. An impingement dryer according to claim 17, wherein the actuator is a spindle motor.

19. An impingement dryer according to claim 11, wherein the impingement dryer is arranged in connection with a vacuum roll in the dryer section of the paper machine.

20. An impingement dryer according to claim 19, wherein the impingement dryer is arranged below the vacuum roll.

21. An impingement dryer according to claim 20, wherein the impingement dryer is arranged below the vacuum roll in the basement of the paper machine.

22. An impingement dryer according to claim 11, wherein the impingement dryer is arranged in connection with a vacuum roll of a larger size than an ordinary vacuum roll of the paper machine.

23. An impingement dryer according to claim 11, wherein the impingement dryer is a planar impingement dryer.

24. An impingement dryer according to claim 11, wherein the temperature of the drying gas is arranged between 200° C. and 600° C.

25. An impingement dryer according to claim 11, wherein the blowing rate of the drying gas is arranged between 50 to 150 m/s.

26. An impingement dryer according to claim 11, wherein the drying gas is air.

27. An impingement dryer according to claim 11, wherein the drying gas is superheated steam.

* * * * *